United States Patent [19]

Patrichi

[11] 4,091,621

[45] May 30, 1978

[54] PYROTECHNIC PISTON ACTUATOR

[75] Inventor: Mihai D. Patrichi, Los Angeles, Calif.

[73] Assignee: Networks Electronic Corp., Chatsworth, Calif.

[21] Appl. No.: 720,364

[22] Filed: Oct. 18, 1976

Related U.S. Application Data

[63] Continuation-in-part of Ser. No. 582,839, Jun. 2, 1975, abandoned.

[51] Int. Cl.[2] ..... F01B 29/08; F02N 13/00

[52] U.S. Cl. ..... 60/635; 60/636

[58] Field of Search ..... 60/635, 632, 636; 89/1 B, 1.5 F; 166/55; 244/150; 30/228, 271

[56] References Cited

U.S. PATENT DOCUMENTS

| | | | |
|---|---|---|---|
| 2,132,148 | 10/1938 | Davis | 269/216 X |
| 2,815,008 | 12/1957 | Hirt | 60/636 |
| 3,111,808 | 11/1963 | Fritz | 60/635 |
| 3,199,288 | 8/1965 | Nahas | 60/635 |
| 3,234,727 | 2/1966 | Filer | 60/632 |
| 3,393,605 | 7/1968 | Parnell | 60/635 |
| 3,530,759 | 9/1970 | Francis | 89/1 B |
| 3,766,979 | 10/1973 | Petrick | 166/55 |
| 3,888,085 | 6/1975 | Larsonneur | 60/635 |

*Primary Examiner*—Wendell E. Burns

[57] ABSTRACT

A piston, normally contained within a cylinder, is projected by electrical detonation of an explosive charge which is contained within the cylinder between the piston and a sealed end of the cylinder through which a detonation contact extends to the charge. A split ring, retained in an annular peripheral groove in the piston, is normally contained under compression within the cylinder, but is resiliently expandible to a diameter larger than the internal diameter of the cylinder when released therefrom by projection of the piston under the expanding gases of the detonated charge, and thereby becomes operative, by abutting engagement with the end of the cylinder, to lock the piston in its projected position, and to hold the reactive load of whatever machine part has been actuated by the piston.

11 Claims, 8 Drawing Figures

PYROTECHNIC PISTON ACTUATOR

This application is a continuation, in part, of prior application Ser. No. 582,839, filed June 2, 1975 and now abandoned.

BACKGROUND OF THE INVENTION

Cylinder-piston type actuators of a wide range of dimensions are utilized in a multitude of applications, in most of which a machine part that has been actuated by projection of the piston, exerts a continuing load on the actuator tending to cause the piston to retract. In hydraulic actuators, this reactive load may be held by blocking return flow of the hydraulic fluid into the cylinder, as by means of an appropriate valve. The same is true of pneumatic actuators. Such actuators are usually heavy and cumbersome and are not suitable for uses wherein a small, lightweight (miniature) actuator is required, as in missiles which do not require any resetting of their actuators for subsequent use, once they have been actuated.

In the patented art, the patent to Fritz U.S. Pat. No. 3,111,808 discloses a single-stroke actuator in which a piston is driven by detonation of an explosive charge, from a retracted position to a projected position in which it is held against return movement by penetration of a sharp edge at the trailing end of the piston into the cylinder wall under the reactive load (e.g. air pressure) tending to thrust the piston back into the cylinder. An actuator or propelling device having an explosive charge-propelled piston is also disclosed in Barr U.S. Pat. No. 3,119,302. Davis U.S. Pat. No. 2,132,148 discloses a piston held within a cylinder by a split ring retainer. Other patents disclosing devices powered by explosive charges are: Gross U.S. Pat. No. 2,742,697, Stupian U.S. Pat. No. 2,897,799, Bohl U.S. Pat. No. 2,924,147 and Stott U.S. Pat. No. 2,942,818.

RÉSUMÉ OF THE INVENTION

The present invention provides a miniature actuator of single-stroke requirement, powered by detonation of an explosive charge so as to project a piston with a sharp, rapid stroke which is relatively in relation to the dimensions of the actuator, and having extremely simple means for preventing return movement, consisting of a split ring carried by the piston, expansively engaging the internal wall of the cylinder and expandible at the end of the piston stroke so as to make abutting engagement with the end of the cylinder and thereby hold the piston securely in its projected position.

In a modified form, the invention provides a miniature actuator which is similar in construction with the exception that the expandible split ring, instead of engaging the inner wall of the cylinder, is held in compressed condition, with its outer surface retained within the diameter of the piston by means of a retainer ring in encircling engagement with said outer surface, such retainer ring being stripped from the split ring upon engagement with an internal shoulder at the end of the cylinder as the piston nears the end of its stroke.

The miniature size and weight of the actuator make it especially suitable for single-stroke actuation of stage operations in the flight of a missile or outer space vehicle, and its simplicity of construction makes it ideally suitable for operation without the possibility of failure. Also, its detonative action makes it especially suitable for split-second timing requirement for stage actuation of the various functions of such a vehicle.

The provision of an actuator having such capabilities is the general object of the invention. Other objects will be apparent in the ensuing specifications, in which.

Figure 1:
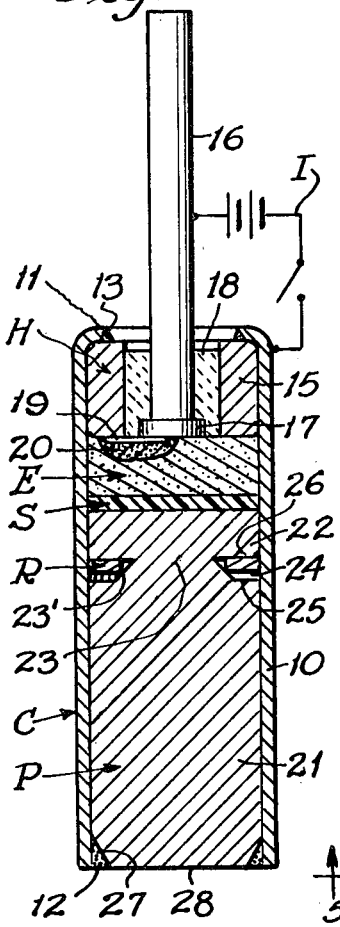
FIG. 1 is an axial sectional view of an actuator embodying the invention, in its normal, retracted position.

Referring now to the drawings in detail, I have shown in FIGS. 1–6 thereof inclusively, as an example of one form in which the invention may be embodied, a miniature pyrotechnic actuator embodying, in general, a cylinder C, a piston P slidable therein, an explosive charge E adjacent the rear end of piston P, a locking ring R, and a detonating and end-sealing header H. A load (e.g. a machine part to be actuated and held in its actuated position) is schematically indicated at L. Load L will normally be such as to stop piston projection at the fully projected position shown in FIG. 2, and to prevent detachment of the piston from the cylinder C.

Cylinder C consists of a cylindrical body 10 (e.g. of metal tubing) having an inturned annular retainer flange 11 at one end (its rear end) and having its other (forward) end open except for a ring 12 of solder and the forward end of piston P which is sealed to such forward end of the cylinder by the solder ring 12. The rear end of the assembly also is sealed by a solder ring, shown at 13. A circular seal disc S of slightly yielding, resilient, gas-impervious material such as polyethylene, is interposed between the explosive charge E and piston P.

Detonating and end-sealing header H comprises an eyelet (cylindrical collar) 15 seated against flange 11 and thereby retained against the reactive thrust of the explosion of charge E; an electrical contact or lead (metal rod or wire) 16 disposed on the axis of the assembly, extending inwardly through the rear end of the cylinder, and having a head 17 in contact with the charge E; an annular cylindrical eyelet 18 of glass, bonded internally to the cylindrical surface of contact 16, and, externally, to the cylindrical internal surface of collar 15; an ignition bridge 19 of fine wire, the respective ends of which are spot-welded to end surfaces of collar 15 and head 17 respectively; and the solder ring 13 which seals the outer end of collar 15 to cylinder flange 11 and cooperates with the annular assembly of collar 15, eyelet 18 and contact 16 to provide a header H which seals the rear end of the cylinder hermetically, thus containing the explosive gases and their reactive thrust so as to direct the force of the explosion wholly in the piston projecting direction.

Collar 15 and contact 16 are both bonded and sealed to glass eyelet 18 to form the sealed header H.

Flange 11 is formed by crimping the end of cylinder 10 around the end of header H, before the solder ring 13 is applied to complete the sealing of the header to the cylinder C and to the contact 16. Flange 11 functions also to contain the axial reactive force of the explosion, providing support for the header H.

The parts to be soldered, i.e. header H and cylinder C, are plated prior to assembling, crimping and applying the sealing solder ring 12. Collar 15, like piston P and contact 16, is of suitable corrosion-resistant metal. Piston P is likewise plated prior to assembly and application of solder ring 12.

Explosive charge E is in the form of a flat, cylindrical disc of powder (either loose or in the form of a cake) contained between the seal disc S and the end faces of collar 15, eyelet 18 and contact head 17, all lying in a common flat plane. Ignition wire bridge 19 is embedded in a spot detonating charge 20 contained within charge E to insure ignition when heated by an electric current transmitted through an electric circuit I from contact 16 through bridge 19 to collar 15 and cylinder C.

Figure 2:
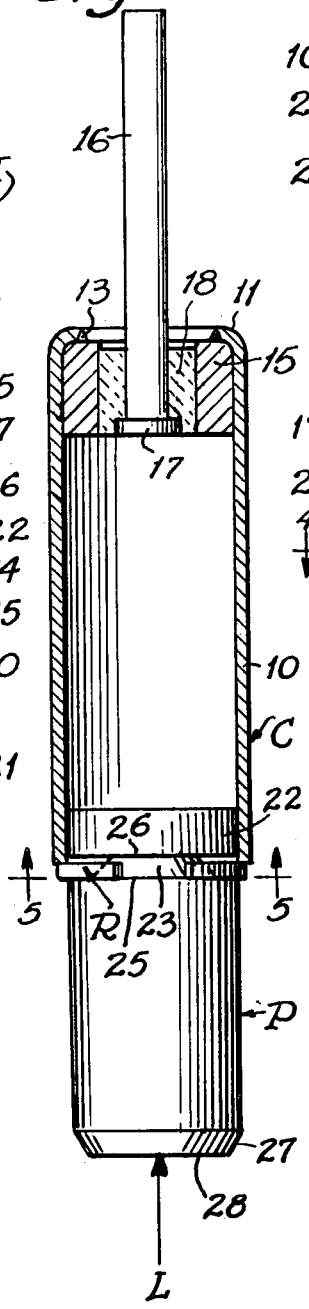
FIG. 2 is an axial view, partially in section, of the actuator with piston locked in extended position.
Figure 6:
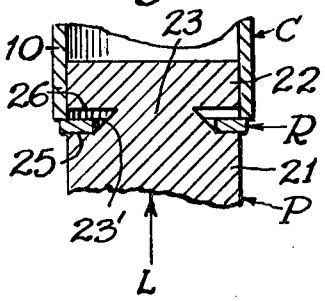
FIG. 6 is a fragmentary axial sectional view taken transversely of FIG. 5.
Figure 3:
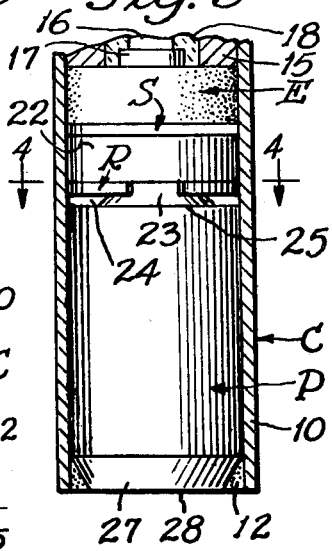
FIG. 3 is a fragmentary view of the actuator, partially in section, showing the piston and locking ring in elevation.
Figure 5:
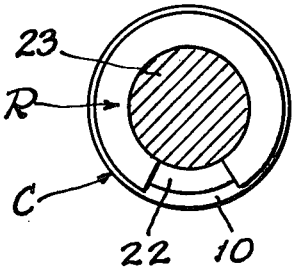
FIG. 5 is a cross-sectional view taken on the line 5—5 of FIG. 2.
Figure 4:
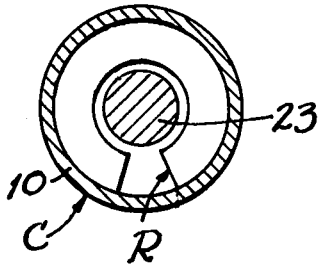
FIG. 4 is a cross-sectional view taken on the line 4—4 of FIG. 3.

Piston P may be a solid body of metal 21 having a flat head 22 of cylindrical peripheral contour joined to body 21 by a neck 23 of frusto-conical form defined as the annular bottom 23' of an annular groove 24, and the opposed, parallel, flat end shoulders 25 and 26 of body 21 and head 22 respectively. In the normal, retracted position of the piston, the locking ring R, of split ring form (FIGS. 4 and 5) and of spring metal material, normally of larger diameter than the internal diameter of the cylinder, is contained within the cylinder under compression in a partially closed condition as shown in FIGS. 1, 3 and 4, and is abutted against the under shoulder 26 of head 22 as a result of camming action of the conical surface of neck 23. Annular groove 24 has an axial depth greater than the thickness of ring R, which is accordingly spaced from the piston body shoulder 25. The clearance between ring R and shoulder 25 is such that when the piston reaches its projected position (FIG. 2) and the collapse of the gas pressure inside the cylinder causes air pressure to exert a retractive force against the outer end of the piston, the ring R will be assisted in its expansion by camming action of the conical surface 23' of neck 23 within the ring.

At its forward end, piston P has a chamfer 27 and an end face 28 which is flush with the end of cylinder C, in a common plane therewith, in the retracted position of the piston. An annular space is defined between chamfer 27 and the inner surface of cylinder C, in which the ring of solder 12 is contained, attaching the piston to the open end of the cylinder with a releasable attachment which will yield to the force of the explosion of charge E, allowing the piston to be projected from the cylinder until stopped by positive action of load L, whereupon locking ring R will be released from the end of the cylinder and will expand into abutting engagement with the cylinder end as shown in FIGS. 2 and 3.

Piston P is slidably mounted in cylinder body 10 with a press-fit tolerance sufficient to avoid penetration of the solder of seal ring 12 between the piston's cylindrical lateral surface and the inner surface of cylinder body 10, thus filling only the groove between chamfer 27 and body 10.

Locking ring R is of a spring type alloy such as Beryllium copper, and is assembled by forcing it over the narrower end of neck 23, springing its ends apart until they pass the diameter of the neck and snap elastically into groove 24. Dimensionally, the maximum diameter of neck 23 is equal to the inner diameter of locking ring R in its unstressed state when expanded outside of cylinder C. This assures perfect centering of the ring (FIG. 6) in the expanded position, with no possibility of the ring shifting radially from the position shown in FIG. 2. Hence the ring will provide solid blocking support between the piston shoulder 25 and the end of cylinder body 10 throughout its entire circumference when expanded. When closed within cylinder body 10, ring R will encircle neck 23 at its minimum diameter with some clearance while abutting the piston head shoulder 26, or vice versa, will be out of contact with shoulder 26 when in contact with the conical surface of neck 23.

Figure 7:
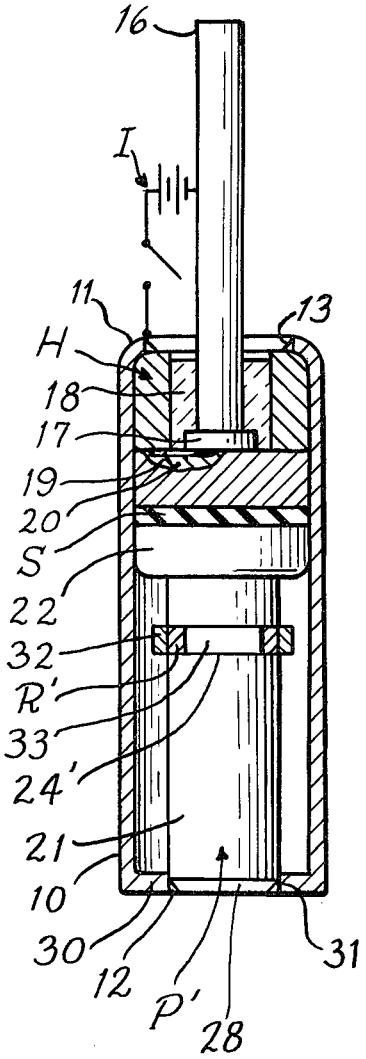
FIG. 7 is an axial sectional view of an actuator embodying a modified form of the invention, shown in its retracted position.
Figure 8:
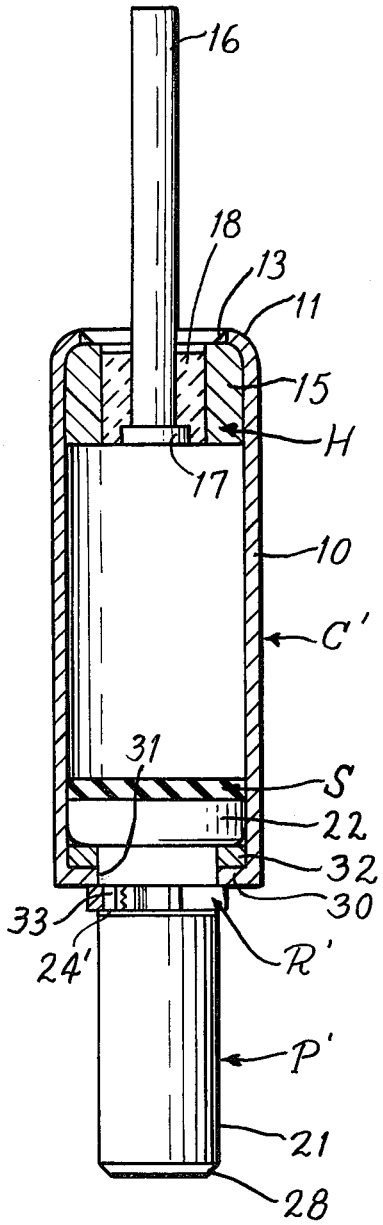
FIG. 8 is an axial sectional view of the actuator of FIG. 7, shown in its extended and locked position following firing.

In the modified form of the invention shown in FIGS. 7 and 8, the piston P' is of smaller diameter than cylinder C', and the latter has at its forward end an inturned flange 30 defining a circular aperture 31 in which piston P' is guided for sliding movement along the axis of the cylinder when charge E is detonated. Locking ring R' is of correspondingly smaller diameter, such that it may pass through aperture 31 when in its compressed condition, and is expandible into abutting engagement with the forward end of cylinder C' when it has cleared the flange 30. Locking ring R' is held in its compressed state by an encircling band 32 during the projection of piston P'. Band 32, which is of larger diameter than aperture 31, is stripped from its confining embracement of ring R' upon being arrested by engagement with the inner face of flange 30, thus allowing R' to expand to its holding position shown in FIG. 8. Band 32 is preferably of Nylon material.

Annular groove 24' has a cylindrical bottom surface defined by neck 33 of piston P', and is of such dimensions as to snugly receive locking ring R' during confinement thereof within band 32. Thus the ring R' will be maintained in coaxial relation to piston P' and cylinder C' until it is inserted into aperture 31 by projection of the piston, and will not catch against flange 30 before passing therethrough.

Other features of the modified form shown in FIGS. 7 and 8 are the same as in the actuator of FIGS. 1–6, and are designated by the same reference characters.

I claim:

1. In a pyrotechnic piston type actuator, in combination:

a cylinder having at its rear end an inturned annular flange;

a detonating header comprising a cylindrical metal collar seated against said flange and a cylindrical eyelet of ceramic material bonded to the internal cylindrical surface of said collar;

an electrical contact rod extending through said eyelet and bonded to the inner surface thereof;

an ignition wire bridging between and secured to the inner ends of said contact rod and said collar respectively;

a piston fitted in said cylinder for axially sliding movement against a load opposed to its forward end;

an explosive charge arranged, when fired, to apply a force of expanding gases to the rear end of said piston such as to project the same against said load;

said ignition wire being in detonating association with said explosive charge;

said piston comprising forward and rear portions separated by an annular groove defined between annular shoulders at the forward end of said rear portion and at the rear end of said forward portion;

and a split ring of spring material seated in said groove, normally confined within said cylinder in a compressed condition and expandible, when released from said confinement, to a diameter such as to make abutting engagement with the forward end of said cylinder in the projected position of said piston in which said ring is released from said confinement;

said ring being engageable with said shoulder of the forward piston portion when so released and the piston is subjected to suction developed by collapse of the expanded gases resulting from the firing of said explosive charge and the ring is pressed against said forward end of the cylinder, whereby said piston is held in said projected position against the action of said suction tending to retract it;

and a ring of solder securing the forward end of said piston to the forward end of said cylinder prior to said firing, said solder ring yielding to the explosive force of said firing so as to release the piston for said projection against the load.

2. An actuator as defined in claim 1, including a disc of slightly compressible, resilient material interposed between the rear end of said piston and said explosive charge, said disc functioning as a seal to prevent blow-by of said expanding gases between said piston and the inner wall of the cylinder.

3. An actuator as defined in claim 2, said disc being of polyethylene material.

4. An actuator as defined in claim 1, said forward and rear piston portions being respectively of major and minor proportions in axial dimensions and constituting a main body and a head respectively;

said groove being wider than the thickness of said ring;

and a frusto-conical neck joining said head to said main body, the major diameter of said neck being adjacent to said main body;

said neck functioning to assist in the expansion of said ring when released from confinement in said cylinder and subjected to said suction of the collapsing gases.

5. An actuator as defined in claim 4, wherein during the projection of said piston said ring is disposed in a plane intersecting the narrower end of said frusto-conical neck, so as to exert minimum expanding force and minimum frictional engagement against the inner wall of said cylinder.

6. In a pyrotechnic piston type actuator, in combination:

a cylinder;

a piston having at its rear end a portion fitted in said cylinder for axially sliding movement against a load opposed to its forward end;

an explosive charge arranged, when fired, to apply a force of expanding gases to said rear end portion of said piston, such as to project the same against said load;

said piston having a body of smaller diameter than, and spaced inwardly from the inner wall of said cylinder so as to define an annular space;

said cylinder having, at its forward end, an inturned flange defining an aperture functioning as a guide for said piston body during projection thereof;

said piston body comprising forward and rear portions separated by an annular groove defined between annular shoulders at the forward end of said rear portion and at the rear end of said forward portion;

a split locking ring of spring material seated in said groove;

an annular band encircling said split locking ring prior to and during projection of said piston and confining said ring to a diameter such that it may pass through said aperture as said piston nears the end of its projection stroke;

said locking ring being normally confined within said annular band in a compressed condition and expandible, when released from such confinement, to a diameter such as to make abutting engagement with the forward end of said cylinder in the projected position of said piston;

said annular space accomodating the forward movement of said band and locking ring along with said piston during said projection stroke;

said band then engaging said inturned flange and being thereby arrested so as to be stripped from said locking ring, thereby to allow said ring to expand into locking engagement with the forward face of said flange at the end of said projection stroke, thereby locking said piston in its projected position.

said locking ring being engageable with said shoulder of the forward piston portion when released from the annular band and the piston is subjected to suction developed by collapse of the expanded gases resulting from the firing of said explosive charge and the ring is pressed against the forward end of the cylinder, whereby said piston is held in such projected position against the action of said suction tending to retract it.

7. An actuator as defined in claim 6, including a detonating and end-sealing collar secured in the rear end of said cylinder, an eyelet of insulating material sealed within said collar, an electrical contact rod extending through and sealed in said eyelet, and a fusible detonator link bridgeing between the inner ends of said collar and contact rod and electrically connected thereto, said link being in detonating relation to said charge.

8. An actuator as defined in claim 7, including a spot detonating charge in contact with said link and said explosive charge.

9. An actuator as defined in claim 7, the rear end of said cylinder having an inturned annular flange abutting and supporting said collar, and a ring of solder sealing said flange to the adjacent end of said collar.

10. An actuator as defined in claim 6, wherein said annular groove has a cylindrical bottom wall defining a neck of reduced diameter which is snugly encircled by said split ring when said ring is retained within said band.

11. An actuator as defined in claim 6, wherein said encircling band is of Nylon material.

* * * * *